US010337320B2

(12) United States Patent
Bondarenko et al.

(10) Patent No.: US 10,337,320 B2
(45) Date of Patent: Jul. 2, 2019

(54) METHOD AND SYSTEMS FOR CAPTURING DATA FOR PHYSICAL STATES ASSOCIATED WITH PERFORATING STRING

(71) Applicant: HALLIBURTON ENERGY SERVICES, INC., Houston, TX (US)

(72) Inventors: Oleg Bondarenko, Spring, TX (US); Wei Zhang, Houston, TX (US); Timothy S. Glenn, Dracut, MA (US); John D. Burleson, Denton, TX (US); John Patrick Rodgers, Southlake, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 212 days.

(21) Appl. No.: 14/783,007

(22) PCT Filed: Jun. 20, 2013

(86) PCT No.: PCT/US2013/046739
§ 371 (c)(1),
(2) Date: Oct. 7, 2015

(87) PCT Pub. No.: WO2015/099634
PCT Pub. Date: Jul. 2, 2015

(65) Prior Publication Data

US 2016/0047235 A1 Feb. 18, 2016

(51) Int. Cl.
*E21B 47/12* (2012.01)
*E21B 43/116* (2006.01)
(Continued)

(52) U.S. Cl.
CPC ..... *E21B 47/124* (2013.01); *E21B 43/11* (2013.01); *E21B 43/116* (2013.01);
(Continued)

(58) Field of Classification Search
CPC ..... E21B 43/11; E21B 43/112; E21B 43/114; E21B 43/116; E21B 43/117;
(Continued)

(56) References Cited

U.S. PATENT DOCUMENTS 6,450,258 B2 * 9/2002 Green ..... E21B 23/04 166/250.17
7,597,142 B2 10/2009 Hartog et al.
(Continued)

FOREIGN PATENT DOCUMENTS

WO 2012078166 6/2012
WO 2012082142 6/2014

OTHER PUBLICATIONS

Bodake et al., "Numerical Analysis and Experimental Validation of a Downhole Stress/Strain Measurement Tool", World Academy of Science, Engineering and Technology, 2013, vol. 73, 838-842.
(Continued)

*Primary Examiner* — Giovanna C Wright
*Assistant Examiner* — Jonathan Malikasim
(74) *Attorney, Agent, or Firm* — Kilpatrick Townsend and Stockton LLP

(57) ABSTRACT

Certain aspects are directed to capturing data regarding physical states associated with a perforating string. In one aspect, a sensing tool is provided. The sensing tool includes at least one sensor and a processor positioned in an isolated chamber of the sensing tool. The processor samples data from the sensor at a first sampling rate associated with the deployment of a perforating string. The data is associated with at least one parameter with respect to the perforating string. The processor detects a trigger condition associated with a perforation operation of the perforating string. The processor switches to a second sampling rate in response to detecting the trigger condition. The second sampling rate is
(Continued)

greater than the first sampling rate and is associated with the perforation operation. The processor samples data at the second sampling rate for a period of time in which the perforation operation is at least partially performed.

20 Claims, 12 Drawing Sheets

(51) Int. Cl.
*E21B 47/06* (2012.01)
*E21B 47/00* (2012.01)
*E21B 43/119* (2006.01)
*E21B 43/11* (2006.01)

(52) U.S. Cl.
CPC ..... *E21B 43/119* (2013.01); *E21B 47/00* (2013.01); *E21B 47/0006* (2013.01); *E21B 47/06* (2013.01)

(58) Field of Classification Search
CPC ..... E21B 43/118; E21B 43/1185; E21B 43/11852; E21B 43/11855; E21B 43/11857; E21B 43/119; E21B 43/1195
See application file for complete search history.

(56) References Cited

U.S. PATENT DOCUMENTS 7,775,273 B2 8/2010 Merlau et al.
7,857,047 B2 * 12/2010 Remmert ..... E21B 12/02 166/250.01
7,894,297 B2 2/2011 Nutt et al.
8,204,565 B2 * 6/2012 Arnold ..... A61B 5/0031 600/310
8,393,393 B2 3/2013 Rodgers et al.
9,328,578 B2 * 5/2016 Kumaran ..... E21B 23/00
2004/0045351 A1 3/2004 Skinner
2007/0007016 A1 1/2007 Sanderlin et al.
2008/0257546 A1 10/2008 Cresswell et al.
2009/0071645 A1 3/2009 Kenison et al.
2009/0272529 A1 11/2009 Crawford et al.
2010/0238025 A1 * 9/2010 Verhulst ..... E21B 49/025 340/539.22
2011/0098931 A1 * 4/2011 Kosmala ..... E21B 47/00 702/12
2012/0057432 A1 * 3/2012 Hill ..... E21B 43/11857 367/81
2012/0152542 A1 6/2012 Le
2012/0158388 A1 * 6/2012 Rodgers ..... G05B 17/02 703/10
2012/0318508 A1 12/2012 Glenn et al.
2013/0098683 A1 4/2013 Turner et al.

OTHER PUBLICATIONS

Halliburton Energy Services, Inc., "DrillDOC® Drilling Downhole Optimization Collar Tool," available at http://www.halliburton.com/ps/default.aspx?pageid=4495&navid=2356&prodid=PRN::L3TIUS15, at least as early as Jan. 1, 2013 (2 pages).
International Patent Application No. PCT/US2013/046739, International Search Report and Written Opinion dated Jul. 6, 2015, 17 pages.

* cited by examiner

METHOD AND SYSTEMS FOR CAPTURING DATA FOR PHYSICAL STATES ASSOCIATED WITH PERFORATING STRING

CROSS REFERENCE TO RELATED APPLICATIONS

This is a U.S. national phase under 35 U.S.C. 371 of International Patent Application No. PCT/US2013/046739, titled "Capturing Data for Physical States Associated With Perforating String" and filed Jun. 20, 2013, which is incorporated herein by reference in its entirety.

TECHNICAL FIELD

The present disclosure relates generally to downhole tools for a well system and, more particularly (although not necessarily exclusively), to capturing data regarding physical states associated with a perforating string.

BACKGROUND

Preparing an oil or gas well for extracting fluids such as petroleum oil hydrocarbons from a subterranean formation can involve deploying tool strings in a well bore. For example, perforating guns may be deployed as part of a tool string to perforate of a tubing string of the well system. A tool string may also include systems, such as sensors coupled to memory devices, for capturing data related to the operations of perforating guns or other downhole tools in the well system. Such data can be downloaded from a tool string after removal from a wellbore and used to improve the design of the tool string.

Prior solutions for capturing data related to the operations of perforating guns or other downhole tools may involve deficiencies. For example, prior solutions may be limited with respect to the types of data captured downhole.

It is desirable provide improved systems for capturing data regarding physical states of a perforating string or other tool string.

DETAILED DESCRIPTION

Figure 1:
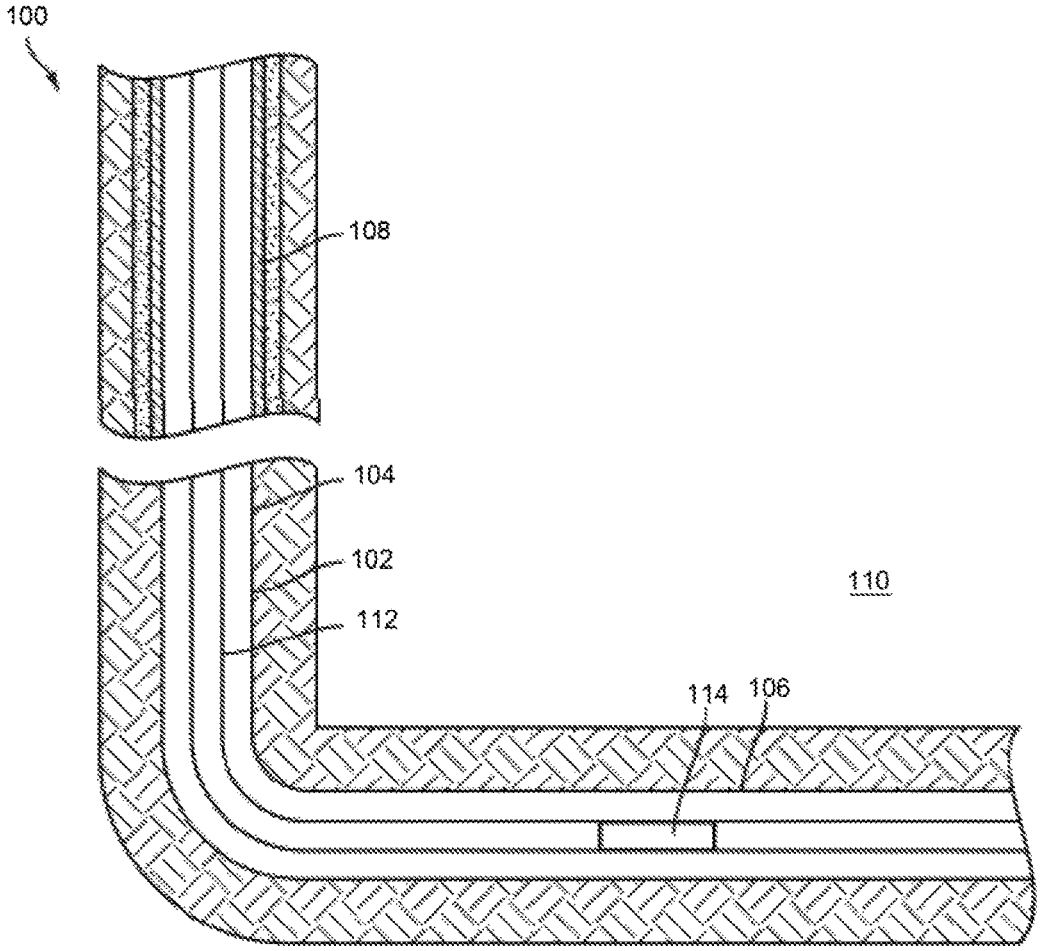
FIG. 1 is a schematic illustration of a well system having a perforating string according to one aspect.

Certain aspects and examples are directed to capturing data regarding physical states associated with a perforating string. Captured data can be used for job evaluation and diagnosis. The data can also provide feedback for continuous operational improvement, such as improving the design and/or configuring of the perforating string. The physical states of a perforating string can include a tension state, a compression state, a bending state, and a torsion state. Other physical states associated with a perforating string can include physical states of an environment in which the perforating string is deployed such as, but not limited to, temperature, pressure, etc. The electronics package for capturing a history of physical states can also be used for deployment of any tool or well system component on which sensing tools can be conveyed, such as the deployment of tools, tubing, coiled tubing, etc.

In some aspects, a sensing tool is provided for capturing data regarding physical states of a perforating string. The sensing tool may be connected between components of the perforating string. The sensing tool can include at least one sensor and a processor positioned in an isolated chamber of the sensing tool. The sensor can measure at least one parameter regarding a perforating string, such as a physical state of the perforating string. Non-limiting examples of physical states of a perforating string include a tension state, a compression state, a bending state, and a torsion state. Non-limiting examples of parameters regarding a perforating string include pressure (such as, but not limited to, external and internal pressure, dynamic pressure, absolute pressure, etc.) near the perforating string, temperature near the perforating string, acceleration of one or more components of the perforating string, strain and stress experienced by one or more components of the perforating string, and the like.

The processor can sample data from the sensor at a first sampling rate that is associated with the deployment of the perforating string. For example, the first sampling rate can be selected for capturing data with respect to operations occurring over a period of time greater than or equal to an hour, such as the deployment of the perforating string in a well system. The processor can detect a trigger condition associated with a perforation operation performed by the perforating string. The trigger condition can include an action with respect to one or more physical states associated with the perforating string exceeding a threshold. For example, the trigger condition may include one or more sensor measurements indicating commencement of a perforation operation. One non-limiting example of a trigger condition is an acceleration and/or velocity associated with one or more perforating guns exceeding a threshold acceleration and/or velocity. Another non-limiting example of a trigger condition is a physical state associated with a perforating string or other tool in which a measuring sensor is installed and/or a physical state associated with an environment in which the perforating string or other tool is deployed. Non-limiting examples of such trigger conditions include a pressure associated with the perforation operation exceeding a threshold pressure, a temperature associated with the perforation operation exceeding a threshold temperature, and a strain associated with the perforation operation exceeding a strain threshold. The processor switches to a second sampling rate in response to detecting the trigger condition. The second sampling rate is greater than the first sampling rate and is associated with capturing information associated with one or more perforation events. The processor samples data at the second sampling rate for a period of time in which the perforation operation is at least partially performed.

In some aspects, the processor used for capturing data regarding physical states can be an auxiliary processor separate from a main processor. For example, a main processor may execute one or more operations to capture data related to detonating the perforating guns of the perforating string. An auxiliary processor may execute one or more operations for capturing data related to deploying/retrieving the perforating string and detonating the perforating guns. Using an auxiliary processor can maximize or otherwise increase dedicated processing capacity usable for capturing data related to long-term operations of the perforating string.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used for purposes of limitation.

FIG. 1 schematically depicts a well system 100 having a tubing string 112 with a perforating string 114. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

The tubing string 112 within wellbore 102 extends from the surface to the subterranean formation 110. The tubing string can include one or more joints that are tubing sections of the tubing string 112. The tubing string 112 can provide a conduit for formation fluids, such as production fluids produced from the subterranean formation 110, to travel from the substantially horizontal section 106 to the surface. Pressure from a bore in a subterranean formation can cause formation fluids, including production fluids such as gas or petroleum, to flow to the surface.

A perforating string 114, depicted as a functional block in FIG. 1, can be deployed in the well system 100. Although FIG. 1 depicts the perforating string 114 in the substantially horizontal section 106, the perforating string 114 can be located, additionally or alternatively, in the substantially vertical section 104. In some aspects, perforating string 114 can be disposed in simpler wellbores, such as wellbores having only a substantially vertical section.

Figure 2:
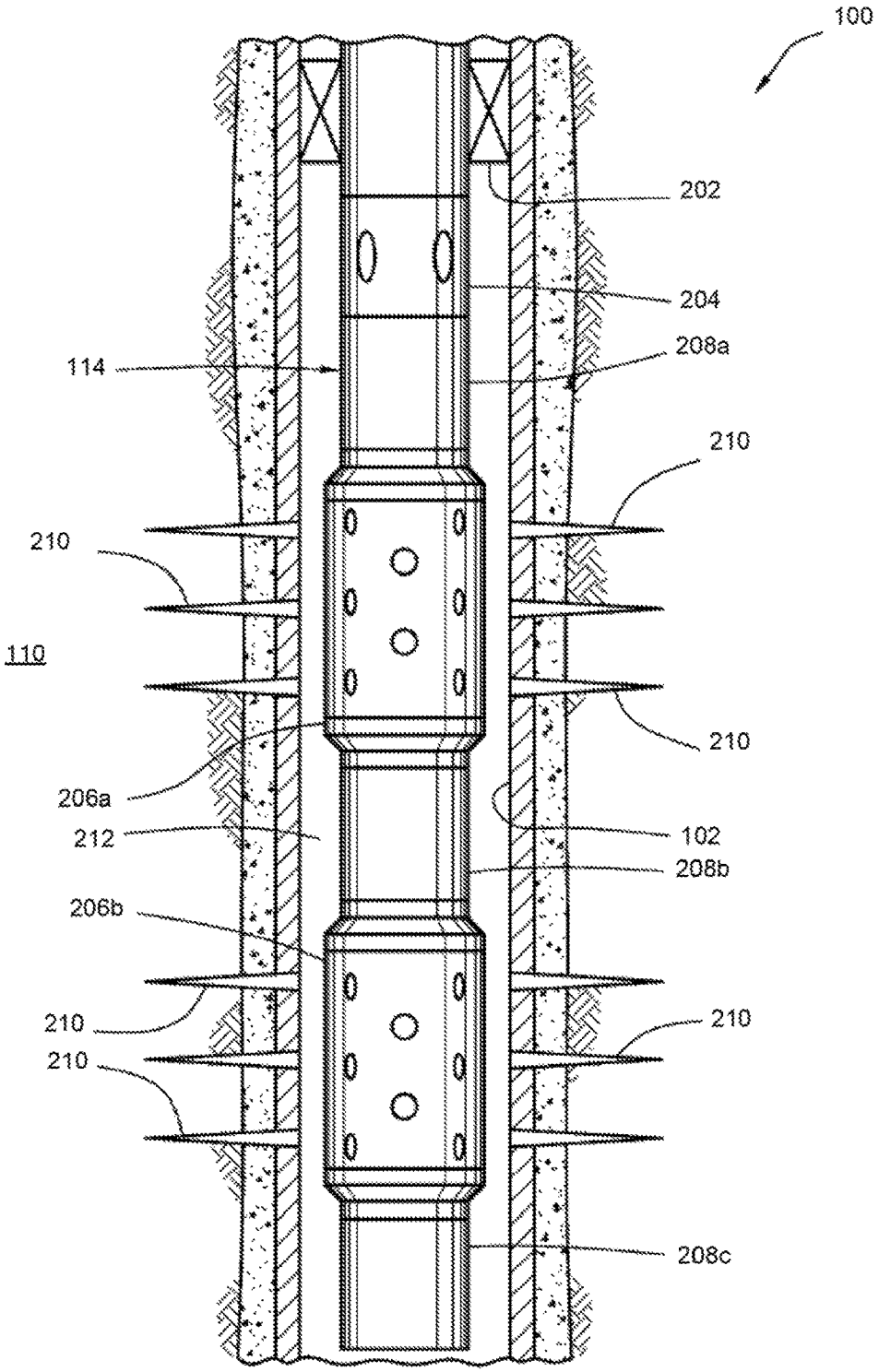
FIG. 2 is a schematic diagram of the perforating string having sensing tools for capturing data regarding physical states associated with the perforating string according to one aspect.

FIG. 2 depicts the perforating string 114 installed in the wellbore 102 of the well system 100. The perforating string 114 includes a packer 202, a firing head 204, perforating guns 206*a*, 206*b* and sensing tools 208*a-c*.

The sensing tool 208 can be interconnected in the perforating string 114 between one of the perforating guns 206*a*, 206*b* and at least another of the perforating guns 206*a*, 206*b* and a firing head 204. In some aspects, the sensing tool can be interconnected in the perforating string 114 between the firing head 204 and the perforating guns 206*a*, 206*b*. In other aspects, the sensing tool 208 can be interconnected in the perforating string 114 between two of the perforating guns 206*a*, 206*b*. In additional or alternative aspects, multiple sensing tools 208*a-c* can be longitudinally distributed along the perforating string 114. At least one of the perforating guns 206*a*, 206*b* may be interconnected in the perforating string 114 between two of the sensing tools 208*a-c*.

In some aspects, interconnecting the sensing tools 208*a-c* below the packer 202 and in close proximity to the perforating guns 206*a*, 206*b* can provide measurements of strain and acceleration at the perforating guns 206*a*, 206*b*. Pressure and temperature sensors of the sensing tools 208*a-c* can sense conditions in the wellbore 102 in close proximity to perforations 210 within a short period of time after the perforations 210 are formed. Sensing conditions in close proximity to perforations 210 within a short period of time after the perforations 210 are formed can improve analysis of characteristics of the subterranean formation 110 penetrated by the perforations 210.

A sensing tool 208*a* interconnected between the packer 202 and the upper perforating gun 206*a* can record the effects of perforating on the perforating string 114 above the perforating guns 206*a*, 206*b*. This information can allow for modifying the design of one or more components of a perforating string 114 to reduce or prevent unsetting or other damage to the packer 202, firing head 204, etc. due to detonation of the perforating guns 206*a*, 206*b*.

A sensing tool 208*b* interconnected between perforating guns 206*a*, 206*b* can record the effects of perforation operations on the perforating guns 206*a*, 206*b*. This information can allow for modifying the design of one or more components of a perforating string 114 to reduce or prevent damage to components of the perforating guns 206*a*, 206*b*.

In some aspects, a sensing tool 208*c* can be connected below the lower perforating gun 206*b* to record the effects of perforating at this location. The information recorded by the lower sensing tool 208*c* can allow for modifying the design of one or more components of a perforating string 114 to reduce or prevent damage to these components. In other aspects, the perforating string 114 can be disposed in a lower completion string and connected to a bridge plug or packer at the lower end of the perforating string 114.

Positioning the sensing tools 208*a-c* longitudinally spaced apart along the perforating string 114 can allow for acquisition of data at various points in the well system 100. For example, collecting data above, between, and below the perforating guns 206*a*, 206*b* can improve understanding of the overall perforating event and its effects on the system as a whole.

The information obtained by the sensing tools 208*a-c* can be used for any suitable purpose. For example, the information obtained by the sensing tools 208*a-c* can be used for post-job analysis, formation testing, and the like.

The perforating string 114 may include any number of the components depicted in FIG. 2. For example, any number (including one) of the perforating guns 206*a*, 206*b* and sensing tools 208*a-c* may be provided. In some aspects, the perforating string 114 may also include additional components, such as (but not limited to) well screens and/or gravel packing equipment. In additional or alternative aspects, the packer 202 may not be included in the perforating string 114.

Figure 3:
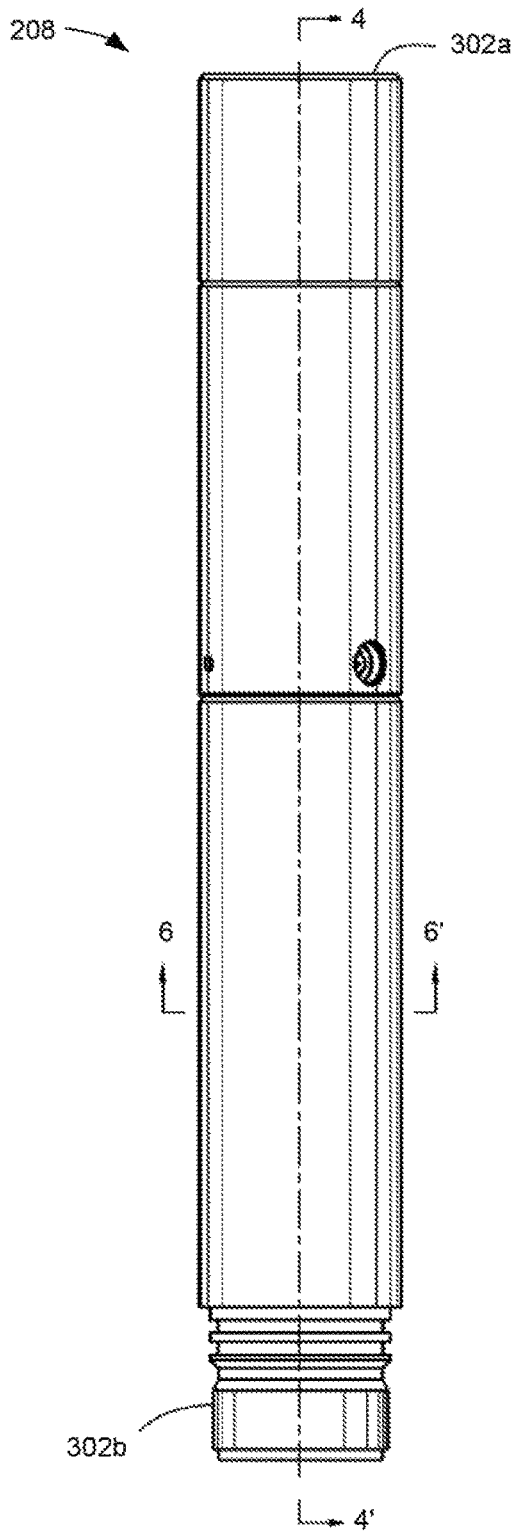
FIG. 3 is a lateral view of an example sensing tool according to one aspect.
Figure 4:
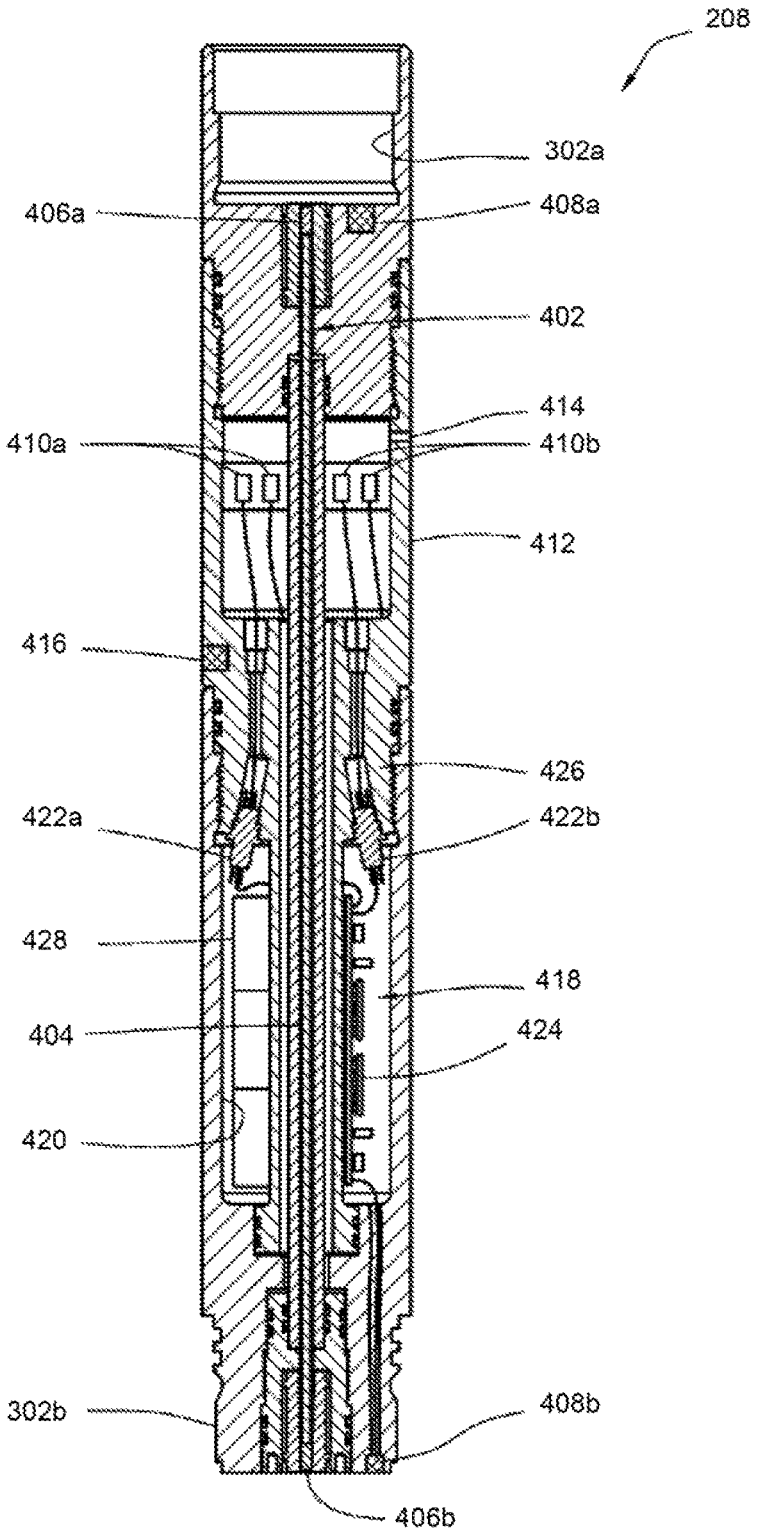
FIG. 4 is a lateral cross-sectional view of the example sensing tool according to one aspect.

FIGS. 3-4 depict a non-limiting example of a sensing tool 208. As depicted in FIG. 3, the sensing tool 208 can include end connectors 302*a*, 302*b* (such as perforating gun connectors, etc.) for interconnecting the sensing tool 208 in the perforating string 114. FIG. 4 depicts a cross-sectional view of the sensing tool 208 taken across the line 4-4' depicted in FIG. 3. The sensing tool 208 can include multiple sensors and a detonation train 402.

The detonation train 402 can extend through the interior of the sensing tool 208. The detonation train 402 can transfer detonation between perforating guns 206*a*, 206*b*, between a firing head (not shown) and a perforating gun, and/or between any other explosive components in the perforating string 114. In some aspects, the detonation train 402 can include a detonating cord 404 and explosive boosters 406*a*, 406*b*, as depicted in FIG. 4. In other aspects, other suitable components can be used to implement the detonation train 402.

The sensing tool can include pressure sensors 408*a*, 408*b*. One or more pressure sensors 408*a*, 408*b* may be used to sense pressure in perforating guns, firing heads, etc., attached to the connectors 302*a*, 302*b*. In some aspects, the pressure sensors 408*a*, 408*b* can be ruggedized. For example, the pressure sensors 408*a*, 408*b* can be designed to withstand approximately 20000 g acceleration. The pressure sensors 408*a*, 408*b* can also be configured to have a high bandwidth (e.g., >20 kHz). In a non-limiting example, the pressure sensors 408*a*, 408*b* can sense pressures up to 60 ksi (414 MPa) and can withstand temperatures up to 175° C.

The sensing tool 208 can also include strain sensors 410*a*, 410*b*. The strain sensors 410*a*, 410*b* can be attached to an inner surface of a generally tubular structure 412 interconnected between the connectors 302*a*, 302*b*. An annulus 212 can be formed radially between the perforating string 114 and the wellbore 102. Both an interior and an exterior of the structure 412 may be exposed to pressure in the annulus 212 between the perforating string 114 and the wellbore 102. The structure 412 may be isolated from pressure in the wellbore 102.

In some aspects, the structure 412 can be pressure-balanced such that little or no pressure differential is applied across the structure 412. Pressure balancing the structure 412 can allow loads (e.g., axial, bending and torsional) to be measured by the strain sensors 410*a*, 410*b* without influence of a pressure differential across the structure 412. The pressure-balanced structure 412 (in which loading is measured by the strain sensors 410*a*, 410*b*) may experience dynamic loading from structural shock by way of being pressure balanced. In some aspects, the detonating cord 404 is housed in a tube that is not rigidly secured at one or both of its ends to prevent sharing loads with or imparting any loading to the structure 412.

In other aspects, the structure 412 may not be pressure balanced. A clean oil containment sleeve can be used with a pressure-balancing piston. Alternatively, post-processing of data from an uncompensated strain measurement can be used in order to approximate the strain due to structural loads. The approximate strain due to structural loads estimation can utilize internal and external pressure measurements to subtract the effect of the pressure loads on the strain gauges, as described below with respect to an alternative configuration of the sensing tool 208.

The sensing tool 208 can also include one or more ports 414. The ports 414 can be used to equalize pressure between an interior and an exterior of the structure 412. In some aspects, the ports 414 can be set to an open position to allow filling of structure 412 with wellbore fluid. In other aspects, the ports 414 are plugged with an elastomeric compound and the structure 412 is filled with a suitable substance (e.g., silicone oil, etc.) to isolate the sensitive strain sensors 410*a*, 410*b* from wellbore contaminants. Equalizing pressure across the structure 412 can reduce or prevent differential pressure across the structure 412 from influencing measurements from the strain the strain sensors 410*a*, 410*b* at times before, during, or after detonation of the perforating guns 206*a*, 206*b*.

Non-limiting examples of the strain sensors 410*a*, 410*b* include resistance wire-type strain gauges, piezoelectric strain sensors, piezoresistive strain sensors, fiber optic strain sensors, etc. As depicted in FIG. 4, the strain sensors 410*a*, 410*b* are mounted to a strip for precise alignment and attached to the interior of the structure 412. In some aspects, four strain sensors that include four full Wheatstone bridges can be used. Opposing strain sensors oriented at 0° and 90° can be used for sensing axial and bending strain. Opposing strain sensors oriented at 45° and −45° can be used for sensing torsional strain.

In some aspects, the strain sensors 410*a*, 410*b* can be made of a material that provides thermal compensation and allows for operation up to 150° C. The strain sensors 410*a*, 410*b* can be used in a manner similar to that of a load cell or load sensor. Some or all of the components of the perforating string 114 can pass through the structure 412 that are instrumented with the sensors 38.

The sensing tool 208 can also include a temperature sensor 416. Non-limiting examples of a temperature sensor 416 include a thermistor, a thermocouple, etc. The temperature sensor 416 can monitor temperature external to the sensing tool 208. Temperature measurements can be useful in evaluating characteristics of the subterranean formation 110 and/or fluid produced from the subterranean formation 110 after detonation of the perforating guns 206*a*, 206*b*. In some aspects, the temperature sensor 416 can perform high-resolution measurements of temperatures up to 170° C.

In some aspects, additional temperature sensors (not depicted) may be included with an electronics package 418 positioned in an isolated chamber 420 of the sensing tool 208. Temperature within the sensing tool 208 can be monitored using temperature sensors in the electronics package 418. The temperature within the sensing tool 208 can be monitored for purposes such as (but not limited to) diagnostic purposes, thermal compensation of other sensors (e.g., to correct for errors in sensor performance related to temperature change, and the like. In some aspects, a temperature sensor in the chamber 420 may not require the high resolution, responsiveness or ability to track changes in temperature quickly in wellbore fluid of the other temperature sensor 416.

The electronics package 418 can be connected to the strain sensors 410*a*, 410*b* via pressure isolating feedthroughs or bulkhead connectors 422*a*, 422*b*. The bulkhead connectors 422*a*, 422*b* may be installed in a bulkhead 426. Similar connectors may also be used for connecting other sensors to the electronics package 418. Batteries 424 and/or another suitable power source can provide electrical power to the electronics package 418.

The electronics package 418 can include a non-volatile memory 428. The memory 428 can be used to store sensor measurements as described in detail below. Storing the sensor measurements can allow the sensor measurements to be downloaded from the sensing tool 208, even if electrical power is no longer available (e.g., if the batteries 424 are discharged).

In some aspects, the electronics package 418 and batteries 424 can be ruggedized and shock mounted in a manner enabling them to withstand shock loads with up to 10000 g acceleration. For example, the electronics package 418 and batteries 424 can be potted after assembly.

Figure 5:
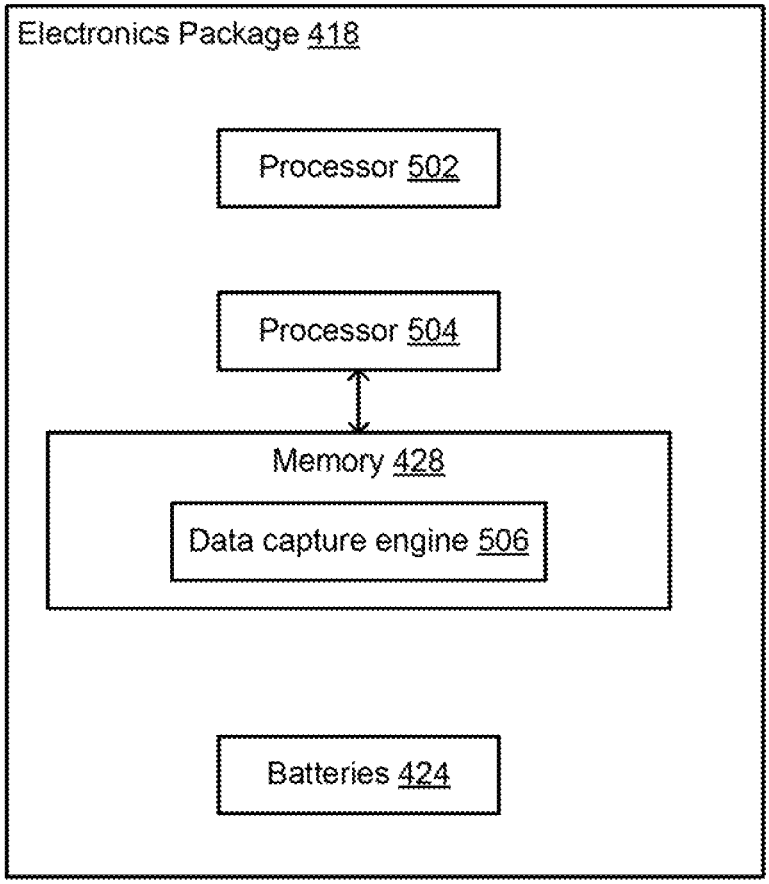
FIG. 5 is a block diagram of an electronics package of the example sensing tool according to one aspect.

FIG. 5 is a block diagram depicting an example electronics package 418. The electronics package 418 includes a processor 502, a processor 504, the memory 428, and the batteries 424.

The processor 502 can execute one or more operations related to deployment of the perforating string 114. The processor 504 can execute a data capture engine 506 embodied in the memory 428 to perform operations for capturing the job history of the physical states of the perforating string 114 and/or the environment in which the perforating string 114 is deployed. In some aspects, the processors 502, 504 can be separate devices, as depicted in FIG. 5. Including separate processors 502, 504 can allow for the processor 502 to be dedicated to operations related to deployment of the perforating string 114 and the processor 504 to be dedicated to data capture operations. Using processor 504 for data capture operations can prevent reducing processing capacity available for operating the perforating string 114. In other aspects, a single processor can perform operations related to deployment and/or operation of the perforating string 114 as well as data capture operations. Non-limiting examples of the processors 502, 504 includes a Field-Programmable Gate Array ("FPGA"), an application-specific integrated circuit ("ASIC"), a microprocessor, etc.

The non-volatile memory 428 may include any type of memory device that retains stored information when powered off. Non-limiting examples of the memory 428 include electrically erasable programmable read-only memory ("ROM"), flash memory, or any other type of non-volatile memory. In some aspects, at least some of the memory 428 can include a medium from which the processor 504 can read instructions. A computer-readable medium can include electronic, optical, magnetic, or other storage devices capable of providing a processor with computer-readable instructions or other program code. Non-limiting examples of a computer-readable medium include, but are not limited to, magnetic disk(s), memory chip(s), ROM, random-access memory ("RAM"), an ASIC, a configured processor, optical storage, and/or any other medium from which a computer processor can read instructions. The instructions may include processor-specific instructions generated by a compiler and/or an interpreter from code written in any suitable computer-programming language, including, for example, C, C++, C#, Java, Python, Perl, JavaScript, etc.

Figure 6:
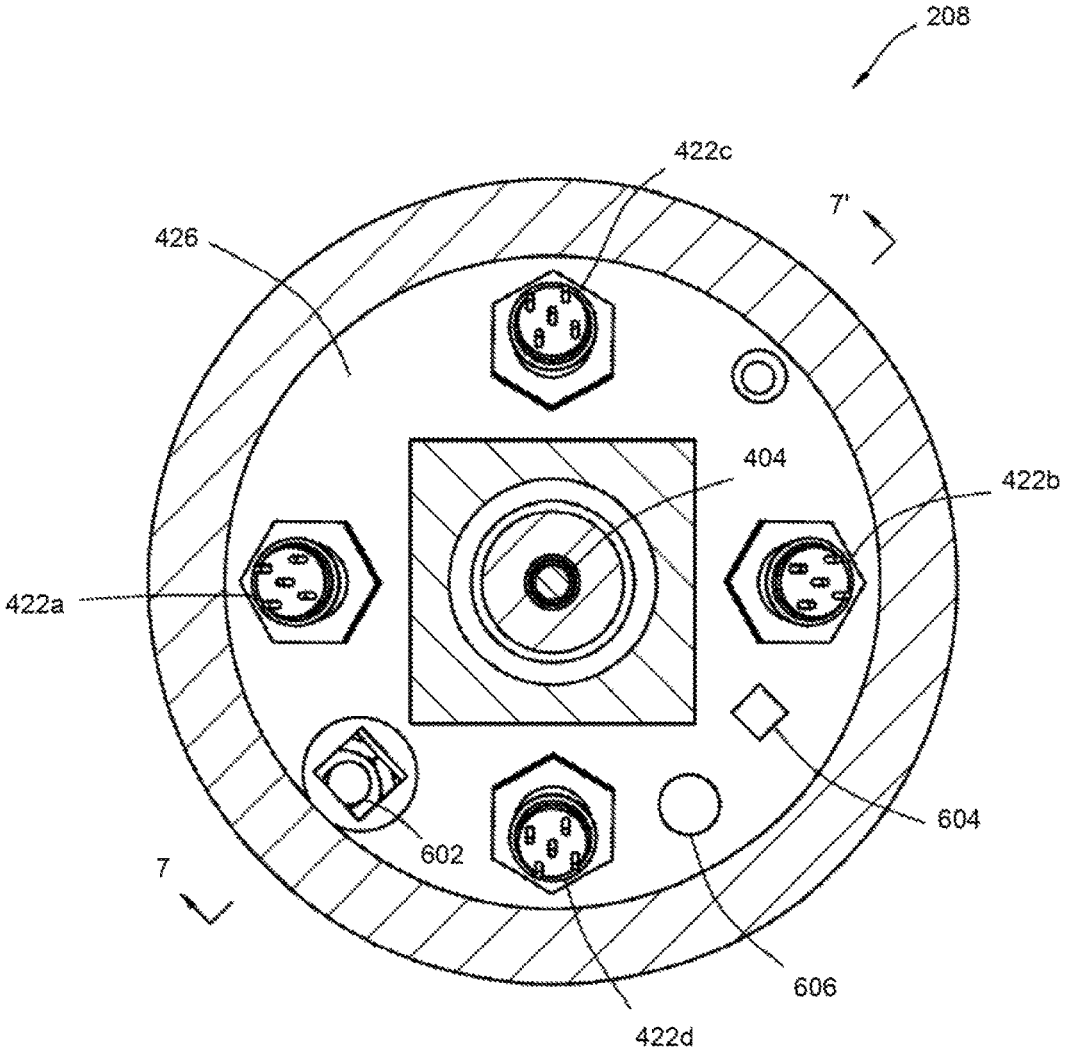
FIG. 6 is a vertical cross-sectional view of the example sensing tool according to one aspect.

FIG. 6 is a cross-sectional view taken across the line 6-6' depicted in FIG. 3. FIG. 6 depicts four bulkhead connectors 422*a-d* installed in a bulkhead 426 at one end of the structure 412. FIG. 6 also depicts a pressure sensor 602, a temperature sensor 604, and an accelerometer 606 can also be mounted or otherwise coupled to the bulkhead 426.

The pressure sensor 602 can monitor pressure external to the sensing tool 208. For example, the pressure sensor 602 can monitor pressure in the annulus 212 formed radially between the perforating string 114 and the wellbore 102. The pressure sensor 602 may be similar to the pressure sensors 408*a*, 408*b* described previously.

The temperature sensor 604 can monitor temperature within the sensing tool 208. In some aspects, the temperature sensor 604 can be used in place of the temperature sensor described previously as being included with the electronics package 418. In other aspects, the temperature sensor 604 can be used in addition to the temperature sensor described previously as being included with the electronics package 418.

The accelerometer 606 can be a piezoresistive accelerometer or other suitable type of accelerometer. The accelerometer 606 can be used to detect acceleration of one or more components of the perforating string 114 at or near the perforating guns 206*a*, 206*b*.

Figure 7:
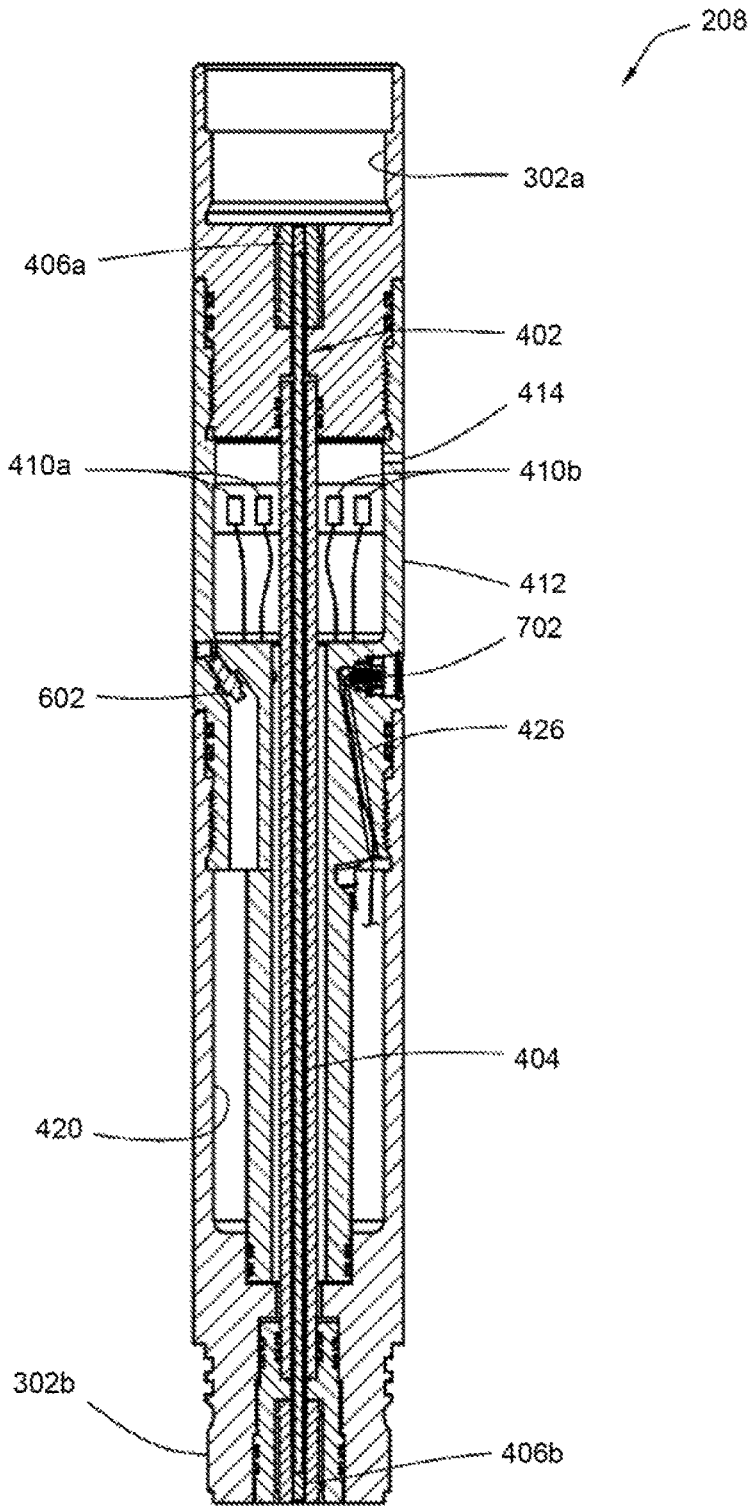
FIG. 7 is an alternative lateral cross-sectional view of the example sensing tool according to one aspect.

FIG. 7 is a cross-sectional view of the sensing tool 208 taken along the line 7-7' depicted in FIG. 6. FIG. 7 depicts the pressure sensor 602 having a port in communication with the exterior of the sensing tool 208. The pressure sensor 602 can be positioned close to an outer surface of the sensing tool 208. Positioning the pressure sensor 602 close to the outer surface of the sensing tool 208 can reduce or prevent distortion of pressure measured by the pressure sensor 602 resulting from transmission of pressure waves through a long narrow passage.

FIG. 7 also depicts a side port connector 702. The side port connector 702 can be used for communication with the electronics package 418 after assembly. For example, a computer can be connected to the side port connector 702 for powering the electronics package 418, extracting recorded sensor measurements from the electronics package, programming the electronics package to respond to a particular signal or to "wake up" after a selected time, and/or otherwise communicating with or exchanging data with the electronics package 418, etc.

In some aspects, hours or days may elapse between assembly of the sensing tool 208 and detonation of the perforating guns 206*a*, 206*b*. Battery power for the electronics package 418 can be preserved by programming the electronics package 418 to "sleep" (i.e., maintain a low power usage state) until a specified signal is received or a specified time period has elapsed. Non-limiting examples of a signal that "wakes" (i.e., changes the state from the low power usage state) the electronics package 418 include any type of pressure, temperature, acoustic, electromagnetic or other signal that can be detected by one or more of the pressure sensors 408*a*, 408*b*, strain sensors 410*a*, 410*b*, temperature sensor 416, pressure sensor 602, temperature sensor 604, accelerometer 606, or any other sensor included in the sensing tool 208. For example, the strain sensors 410*a*, 410*b* can detect a predetermined pattern of manipulations of the perforating string 114 (such as particular manipulations used to set the packer 202). In response to this detection of manipulations, the electronics package 418 can "wake" to record measurements from more sensors and/or higher frequency sensor measurements. In another example, the pressure sensor 602 can detect that a certain pressure level has been achieved or applied external to the sensing tool 208, that a particular series of pressure levels has been applied, etc. In response to the pressure sensor 208 detecting the pressure level(s), the electronics package 418 can be activated to a higher measurement recording frequency, measurements from additional sensors can be recorded, etc. In another example, the temperature sensor 604 can sense an elevated temperature resulting from installation of the sensing tool 208 in the wellbore 102. In response to the detection of elevated temperature, the electronics package 418 can "wake" to record measurements from more sensors and/or higher frequency sensor measurements.

Figure 8:
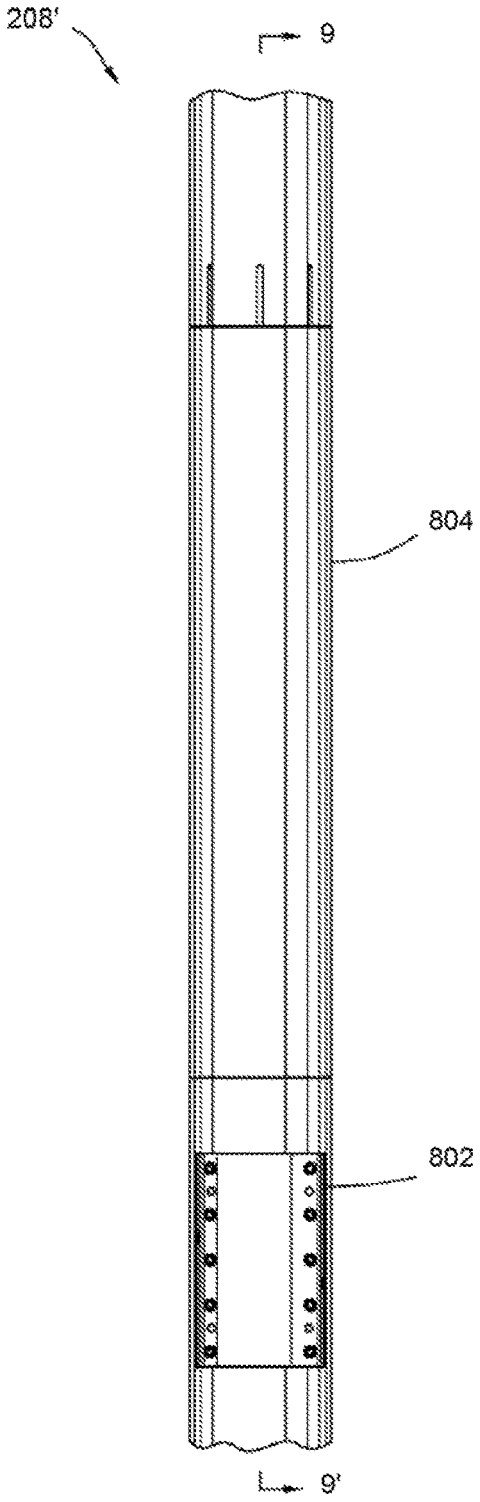
FIG. 8 is a lateral view of an alternative configuration of the example sensing tool according to one aspect.
Figure 9:
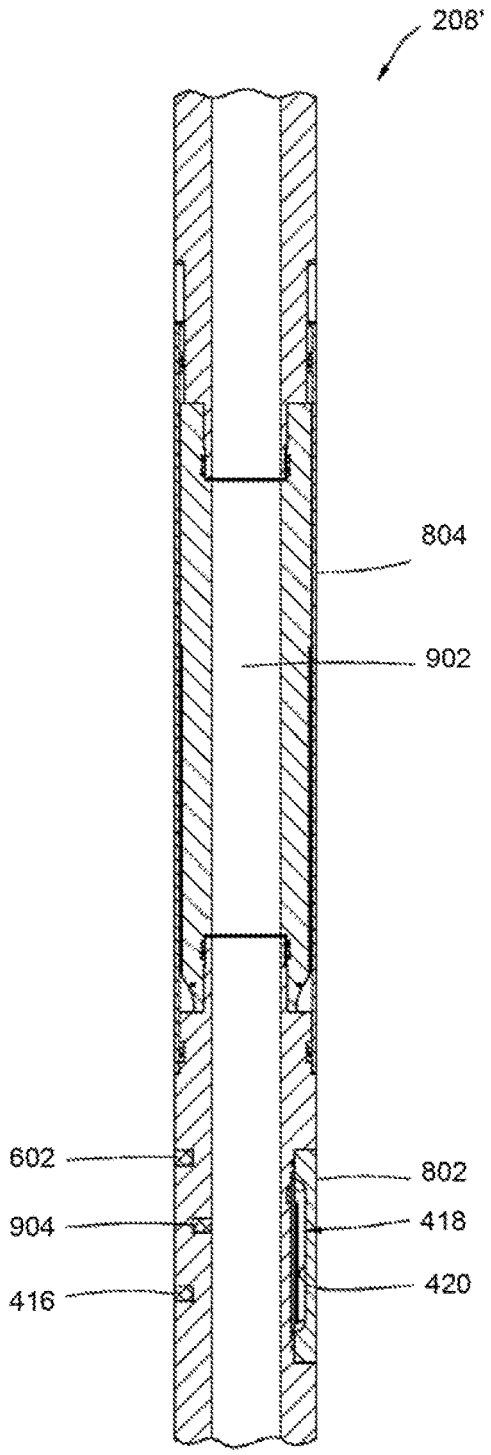
FIG. 9 is a lateral cross-sectional view of an alternative configuration of the example sensing tool according to one aspect.
Figure 10:
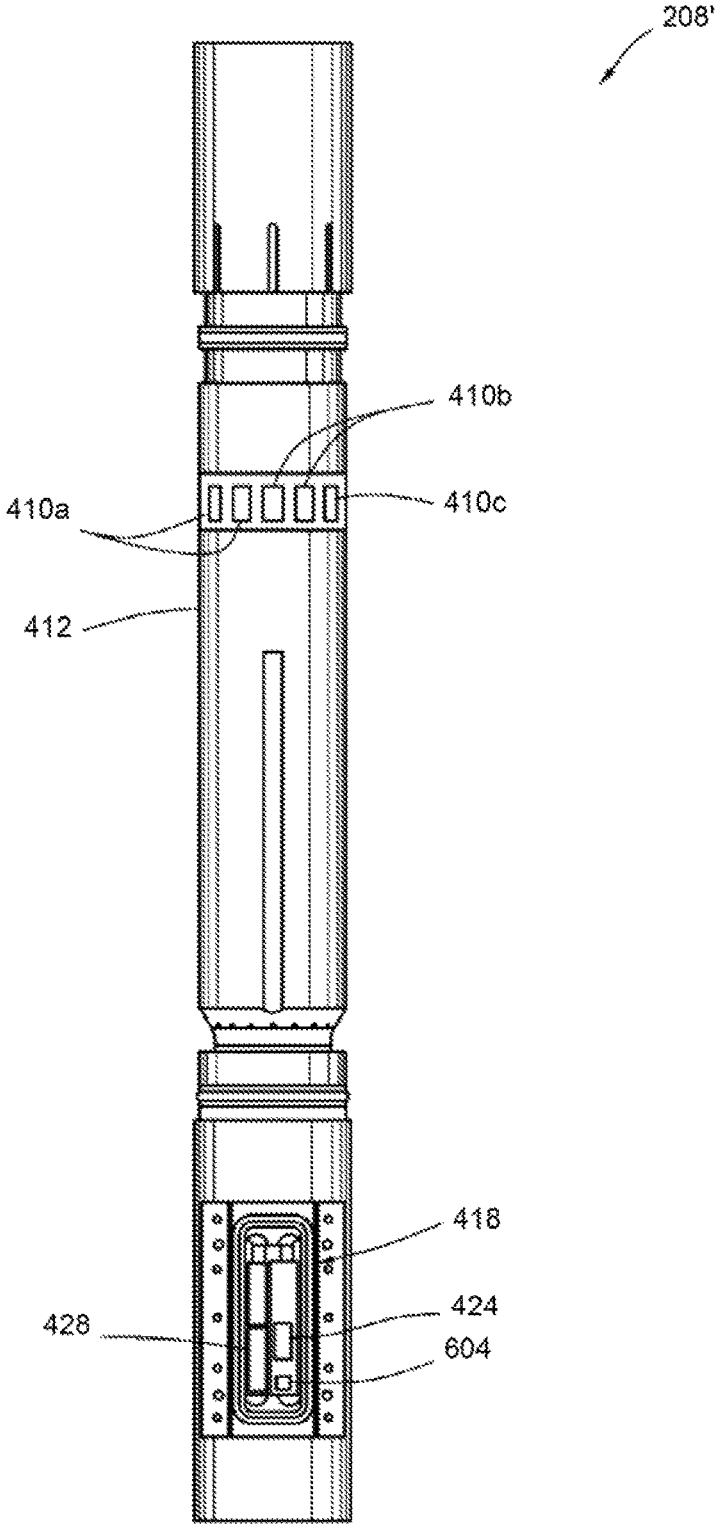
FIG. 10 is a lateral view of an alternative configuration of the example sensing tool according to one aspect.

FIGS. 8-10 depict an alternative configuration of a sensing tool 208'.

FIG. 8 depicts a removable cover 802 for the sensing tool 208' that can house the electronics package 418, batteries 424, etc. A protective sleeve 804 can prevent damage to the strain sensors 410*a*, 410*b* that are attached to an exterior of the structure 412. In some aspects, no pressure differential may exist across the protective sleeve 804. A suitable substance (such as silicone oil, etc.) can be used to fill the annular space between the protective sleeve 804 and the structure 412. The protective sleeve 804 may not be rigidly secured at one or both of its ends such that the protective sleeve 804 it does not share loads with or impart loads to the structure 412.

FIG. 9 is a cross-sectional view taken along the line 9-9' depicted in FIG. 8. FIG. 9 depicts a flow passage 902 extending longitudinally through the sensing tool 208. The flow passage 902 extending longitudinally through the sensing tool 208 may allow for improved interconnection between the packer 202, the upper perforating gun 206*a*, and the sensing tool 208'. As depicted in FIG. 8-9, the structure 412 may not be pressure balanced. A pressure sensor 904 can monitor pressure in the flow passage 902. Monitoring pressure in the flow passage 902 can allow any for determining a contribution of the pressure differential across the structure 412 to the strain measured by the strain sensors 410*a*, 410*b*. The effective strain due to the pressure differential across the structure 412 as measured by the pressure sensor 904 can be subtracted from the strain measured by the strain sensors 410*a*, 410*b*.

FIG. 10 depicts the sensing tool 208' with the cover 802 removed. As depicted in FIG. 10, the electronics package 418 can include the temperature sensor 604. In some aspects, the accelerometer 606 can also be included in the electronics package 418. In other aspects, the accelerometer 606 can be positioned in the chamber 420 under the cover 802.

Any of the sensors described above for use with the sensing tool 208 configuration of FIGS. 3-7 may also be used with the tool configuration of FIGS. 8-10.

The structure 412 that is not pressure balanced may limit dynamic loading to structural shock using a pair of pressure isolating sleeves. One of the pressure isolating sleeves can be used external the load bearing structure 412 in the configuration depicted in FIGS. 8-10. One of the pressure isolating sleeves can be used internal the load bearing structure 412 in the configuration depicted in FIGS. 8-10. The sleeves can encapsulate air at atmospheric pressure on both sides of the structure 412. Encapsulating air at atmospheric pressure on both sides of the structure 412 can isolate the structure 412 from the loading effects of differential pressure. The sleeves may strong enough to withstand the pressure in the well system 100, and may be sealed with o-rings or other seals on both ends. In some aspects, the sleeves may be structurally connected to the sensing tool 208 at no more than one end such that a secondary load path around the strain sensors 410*a*, 410*b* is prevented.

Figure 11:
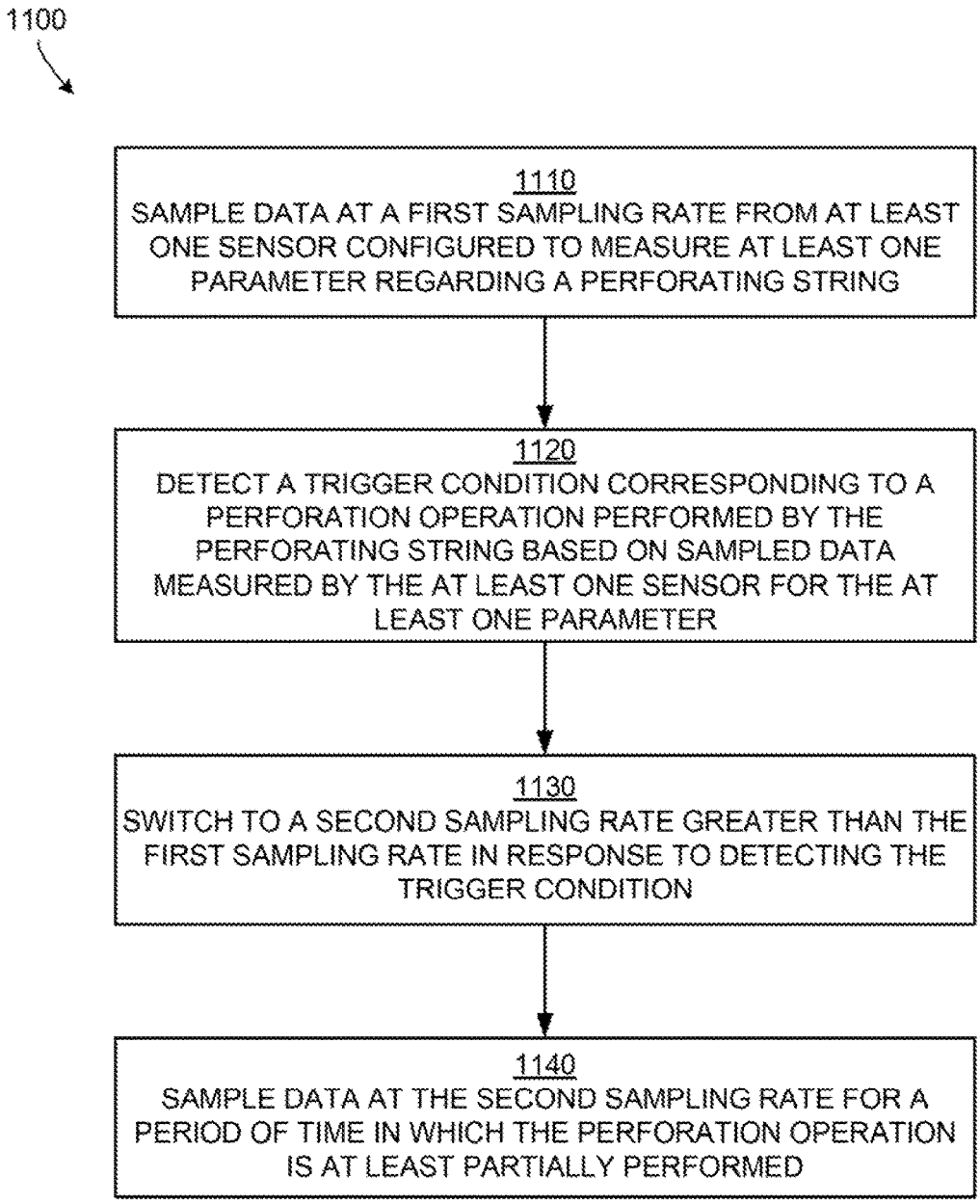
FIG. 11 is a flow chart of a process for capturing data regarding physical states associated with a perforating string according to one aspect.

FIG. 11 is a flow chart of an example process 1100 for capturing data regarding physical states associated with a perforating string 114 according to one aspect.

At block 1110, the processor 504 samples data from one or more of the sensors in the sensing tool 208 at a first sampling rate associated with deployment of the perforating string 114. The first sampling rate can be used for capturing data from the sensors that relates to physical states (e.g., a tension state, a compression state, a bending state, and a torsion state) experienced by one or more components during deployment of the perforating string 114. The processor 504 can execute the data capture engine 506 to sample the data from the one or more sensors at the first sampling rate. For example, the processor 504 can sample data from one or more of the pressure sensors 408*a*, 408*b*, the strain sensors 410*a*, 410*b*, the temperature sensor 416, the pressure sensor 602, the temperature sensor 604, the accelerometer 606, the pressure sensor 904, and/or any combination thereof. In some aspects, the first sampling rate can be selected for capturing data with respect to operations occurring over a period of time greater than or equal to an hour, such as deploying the perforating string 114 over a period of days. Non-limiting examples of the first sampling rate include sampling rates of ten samples per second and 100 samples per second.

The first sampling rate associated with deployment of the perforating string 114 can be used to capture long-term data from the sensors over a period of time that is longer in duration than rapid operations, such as actuation of the perforating guns 206*a*, 206*b*. For example, capturing short-term data related to creating the perforations 210 via detonation of the perforating guns 206*a*, 206*b* can involve capturing data over a period of one or more seconds. Capturing long-term data related to running the perforating string 114 into the wellbore 102 can involve capturing data over a period of hours or days.

Long-term data can describe events occurring during deployment of the perforating string, such as compression of the tubing, bending of the tubing, torqueing of the tubing, and the like. In one example, the strain sensors 410*a*, 410*b* can detect a predetermined pattern of manipulations of the perforating string 114 (such as particular manipulations used to set the packer 202). In another example, the pressure sensor 602 can detect that a certain pressure level has been achieved or applied external to the sensing tool 208, that a particular series of pressure levels has been applied, etc. In another example, the temperature sensor 604 can sense an elevated temperature resulting from installation of the sensing tool 208 in the wellbore 102.

At block 1120, the processor 504 detects a trigger condition that is associated with a perforation operation performed by the perforating string 114. The trigger condition can be detected based on sampled data associated with one or more parameters measured by the sensors. A perforation operation can include detonating or otherwise actuating one or more of the perforating guns 206*a*, 206*b*.

The processor 504 of the electronics package 418 can execute the data capture engine 506 to detect the trigger condition based on data sampled from the one or more sensors. For example, the data capture engine 506 can detect the trigger condition by comparing data sampled from one or more of the sensors to a threshold value. The data capture engine 506 can determine that measurements sampled from the one or more sensors have values above the threshold value. For example, the data capture engine 506 can determine that a specified number of consecutive samples or a number of samples obtained during a specified time period have values above the threshold value.

In some aspects, the trigger condition can include an acceleration and/or a velocity of the perforating guns 206*a*, 206*b* exceeding a threshold acceleration or velocity. For example, the movement of one or more components of the perforating guns 206*a*, 206*b* may accelerate before and/or during detonation of the perforating guns 206*a*, 206*b* detonation. The accelerometer 606 or another suitable device can measure the acceleration and/or velocity of one or more components of the perforating guns 206*a*, 206*b*. The processor 504 can obtain the acceleration and/or velocity measurements from the accelerometer 606 or other sensing device. The data capture engine 506 can compare the measured acceleration and/or velocity to a threshold acceleration and/or velocity value stored in the memory 428. The data capture engine 506 can determine that the measured acceleration and/or velocity is greater than or equal to the threshold acceleration and/or velocity value.

In additional or alternative aspects, the trigger condition can include a measured pressure exceeding a threshold pressure. One or more of the pressure sensors 408*a*, 408*b*, 602, 904 can measure pressure in the wellbore 102. The processor 504 can obtain the pressure measurements from one or more of the pressure sensors 408*a*, 408*b*, 602, 904. The data capture engine 506 can compare the measured pressure to a threshold pressure value stored in the memory 428. A threshold pressure value may be, for example, a pressure that is associated with the detonation of one or more of the perforating guns 206*a*, 206*b*. The data capture engine 506 can determine that the measured pressure is greater than or equal to the threshold pressure value.

In additional or alternative aspects, the trigger condition can include a measured strain exceeding a threshold strain. One or more of the strain sensors 410*a*, 410*b* can measure strain in the perforating string 114. The processor 504 can obtain the strain measurements from one or more of the strain sensors 410*a*, 410*b*. The data capture engine 506 can compare the measured strain to a threshold strain value stored in the memory 428. The threshold strain value can be associated with the detonation of one or more of the perforating guns 206*a*, 206*b*. The data capture engine 506 can determine that the measured strain is greater than or equal to the threshold strain value.

At block 1130, the processor 504 can switch to a second sampling rate for sampling data from the sensors that is associated with the perforation operation of the perforating string 114. The second sampling rate is a higher sampling rate than the first sampling rate. The processor 504 of the electronics package 418 can execute the data capture engine 506 to switch from the first sampling rate to the second sampling rate. For example, the data capture engine 506 can configure the processor to increase the sampling rate in response to detecting the trigger condition. In some aspects, the second sampling rate can be selected for capturing data with respect to operations occurring over a period of time less than or equal to one minute, such as a perforation operation having a duration of one or more seconds. Non-limiting examples of the second sampling rate include sampling rates of 1,000 samples per second or 100,000 samples per second.

At block 1140, the processor 504 can sample data at the second sampling rate for a period of time in which the perforation operation is at least partially performed. The processor 504 of the electronics package 418 can execute the data capture engine 506 to sample the data from the sensors at the second sampling rate.

In some aspects, the processor 504 can switch from the second sampling rate to the first sampling rate after a specified period of time. The specified period of time can be a configurable value stored in the memory 428. The data capture engine 506 can access the specified period of time. The data capture engine 506 can determine that the processor 504 has sampled data at the second sampling rate for the specified period of time. In some aspects, the data capture engine 506 can configure the processor 504 to switch to the first sampling rate based on the expiration of the specified period of time. In additional or alternative aspects, the data capture engine 506 can configure the processor 504 to switch to an intermediate sampling rate based on the expiration of the specified period of time. The intermediate sampling rate can be a sampling rate greater than the first sampling rate and less than the second sampling rate.

In other aspects, the processor 504 can switch from the second sampling rate to the first sampling rate in response to detecting the absence of the trigger condition subsequent to detecting the presence of the trigger condition. For example, the data capture engine 506 can compare data sampled from one or more of the sensors at the second sampling rate to a threshold value. The data capture engine 506 can determine that measurements have values below the threshold value. For example, the data capture engine can determine that a specified number of consecutive samples or a number of samples obtained during a specified time period have values below the threshold value. The data capture engine 506 can configure the processor 504 to switch to the first sampling rate based on the measurements from the one or more sensors having values below the threshold value.

Although the perforating string 114 described above is of the type used in tubing-conveyed perforating, other implementations are possible. For example, other types of perforating (such as perforating via coiled tubing, wireline, slickline, etc.) may incorporate the principles described herein.

Figure 12:
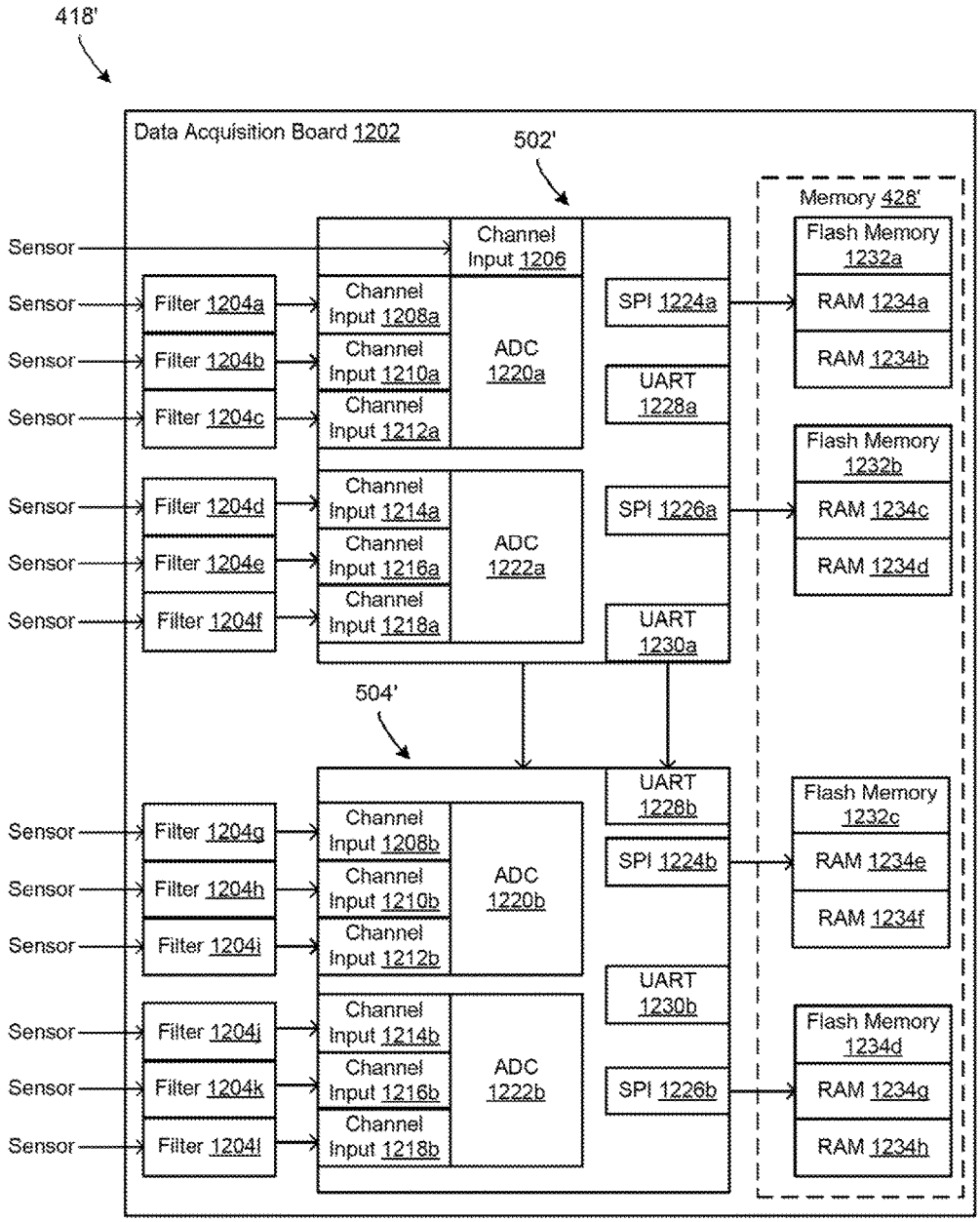
FIG. 12 is a block diagram of an alternative example of an electronics package having a data acquisition board according to one aspect.

FIG. 12 is a block diagram of an alternative implementation of the electronics package 418'. The electronics package 418' can include a data acquisition board 1202. The data acquisition board 1202 can include a master processor 502' or other suitable microcontroller, a slave processor 504' or other suitable microcontroller, filters 1204*a-l*, and memory 428'.

The master processor 502' can include channel inputs 1206, 1208*a*, 1210*a*, 1212*a*, 1214*a*, 1216*a*, 1218*a*, analog-to-digital converters ("ADC") 1220*a*, 1222*a*, serial peripheral interface ("SPI") buses 1224*a*, 1226*a*, and universal asynchronous receiver/transmitters ("UART") 1230*a*, 1230*b*. The slave processor 504' can include channel inputs 1208*b*, 1210*b*, 1212*b*, 1214*b*, 1216*b*, 1218*b*, ADC's 1220*b*, 1222*b*, SPI buses 1224*b*, 1226*b*, and UART's 1228*b*, 1230*b*.

Each of the filters 1204*a-l* can be communicatively coupled to a respective one of the sensors of the sensing tool 208 described previously. The filters 1204*a-l* can be analog filters that decrease noise in signals received from the sensors. A non-limiting example of an analog filter is fourth order Butterworth filter.

Each of the filters 1204*a-f* can provide a filtered analog signal to the master processor 502' via the respective channel inputs 1208*a*, 1210*a*, 1212*a*, 1214*a*, 1216*a*, 1218*a*. In some aspects, another sensor (such as, but not limited to, a temperature sensor) can be connected to the master processor 502' via the channel input 1206. Each of the filters 1204*g-l* can provide a filtered analog signal to the slave processor 504' via the respective channel inputs 1208*b*, 1210*b*, 1212*b*, 1214*b*, 1216*b*, 1218*b*.

The ADC 1220*a* can read signals from the channel inputs 1206, 1208*a*, 1210*a*, 1212*a*. The ADC 1222*a* can read signals from the channel inputs 1214*a*, 1216*a*, 1218*a*. The ADC 1220*b* can read signals from the channel inputs 1208*b*, 1210*b*, 1212*b*. The ADC 1222*a* can read signals from the channel inputs 1214*b*, 1216*b*, 1218*b*. Each of the ADC's 1220*a*, 1220*b*, 1222*a*, 1222*b* can convert analog signals read from the channel inputs to digital data using a specified sampling rate, such as the first sampling rate, the second sampling rate, and/or the intermediate sampling rate described above with respect to FIG. 11.

The memory 428' can include flash memory 1232*a-d* and random access memory ("RAM") 1234*a-h*. The master processor 502' can write or otherwise store digital data to one or more of the flash memory 1232*a* and/or the RAM 1234*a*, 1234*b* via the SPI bus 1224*a*. The master processor 502' can write or otherwise store digital data to one or more of the flash memory 1232*b* and/or the RAM 1234*c*, 1234*d* via the SPI bus 1226*a*. The slave processor 504' can write or otherwise store digital data to one or more of the flash memory 1232*c* and/or the RAM 1234*e*, 1234*f* via the SPI bus 1224*b*. The slave processor 504' can write or otherwise store digital data to one or more of the flash memory 1232*c* and/or the RAM 1234*g*, 1234*h* via the SPI bus 1226*b*.

Figure 13:
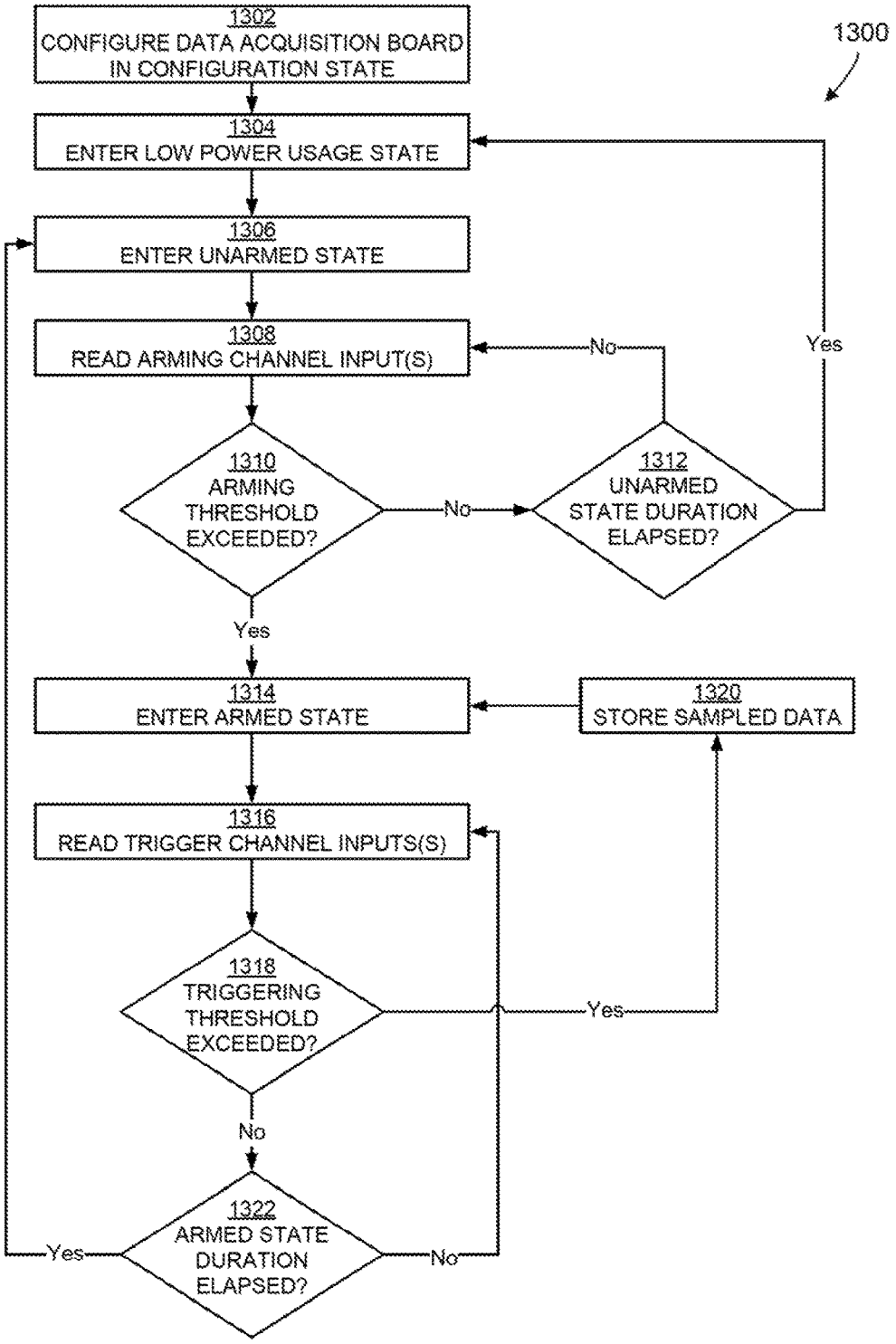
FIG. 13 is a flow chart of a process for switching between states of the data acquisition board according to one aspect.

The data acquisition board 1202 can operate in multiple states, such as (but not limited to) a configuration state, an unarmed state, and an armed state. In some aspects, the data acquisition board 1202 can also be operated in a slow sampling state. FIG. 13 is a flow chart of a process 1300 for switching between states in which the data acquisition board 1202 can be operated. The process 1300 can be implemented using the data acquisition board 1202 depicted in FIG. 12. Other implementations, however, are possible.

The data acquisition board 1202 can be configured by an operator during a configuration state, as depicted at block 1302. The data acquisition board 1202 can be configured by an operator using an external control device (not depicted in FIG. 12). Non-limiting examples of an external control device include a laptop computer, desktop computer, etc. The external control device can be communicatively coupled to the master processor 502' via the UART 1228*a* or other suitable interface and to the slave processor 504' via the UART 1228*b* or other suitable interface. The configuration state may include the data acquisition board 1202 being configured by an operator for a down-hole job. Configuring the data acquisition board 1220 can involve setting values for parameters such as (but not limited to) a trigger channel number and a trigger threshold, an arming channel number and an arming threshold, a time-delayed arming interval, and the like. In some aspects, the time-delayed arming interval can be omitted. The configuration state may also include downloading data stored to the memory 428' from a prior downhole job.

The configured data acquisition board 1200 can enter a low power usage state, as depicted at block 1304. The low power usage state can allow battery power for the electronics package 418' to be preserved.

The data acquisition board 1200 can switch from the low power usage state to the unarmed state, as depicted at block 1306. The master processor 502' may "wake" (i.e., switch state from a low power usage state) at a predefined frequency. A non-limiting example of a frequency at which the master processor 502' can enter the unarmed state from the low power usage state is once every eight seconds.

In the unarmed state, the master processor 502' can read one or more arming channel inputs, as depicted at block 1308. An arming channel input can be a channel input that is communicatively coupled to one or more other sensors measuring one or more arming parameters. The arming channel input(s) can be specified by an operator in the configuration state.

The master processor 502' can determine whether the signal level read from the arming channel input(s) exceeds an arming threshold, as depicted at block 1310. The arming threshold can be specified by an operator in the configuration state. If the signal level is below the arming threshold, the data acquisition board 1202 can determine if a specified duration for the unarmed stated has elapsed, as depicted at block 1312. If the specified duration for the unarmed stated has elapsed, the data acquisition board 1202 can switch to the low power usage state, as depicted in FIG. 13 by the process 1300 returning to block 1304. If the specified duration for the unarmed stated has not elapsed, the data acquisition board can continue reading the arming channel input(s), as depicted in FIG. 13 by the process 1300 returning to block 1308.

If the signal level read from the arming channel input is above the arming threshold, the data acquisition board 1202 can switch to an armed state, as depicted at block 1314. In additional or alternative aspects, the data acquisition board 1202 may switch to the armed state after the time-delayed arming interval specified during the configuration state. The armed state can involve the master processor 502' and the slave processor 504' sampling data at a high sampling rate. An armed state can have a short duration (such as, but not limited to 50 milliseconds). A short duration of the armed state can preserve battery power for the electronics package 418'.

In the armed state, the master processor 502' and the slave processor 504' can monitor data obtained from one or more trigger channel inputs, as depicted at block 1316. The trigger channel input(s) can be specified by an operator in the configuration state.

The master processor 502' and the slave processor 504' can determine whether the signal level read from the trigger channel input(s) exceeds a trigger threshold, as depicted at block 1318. The trigger threshold can be specified by an operator in the configuration state. If the signal level read from the trigger channel input(s) exceeds the trigger threshold, the master processor 502' and the slave processor 504' can store data obtained from some or all channel inputs to the memory 428', as depicted at block 1320. A non-limiting example of a time interval for storing the data is one second, with a ten-millisecond time interval before detection of the triggering event. After an event is detected and stored to memory, the data acquisition board can remain in the armed state, as depicted in FIG. 13 by the process 1300 returning to block 1314. If the signal level read from the trigger channel input(s) does not exceed the trigger threshold, the data acquisition board 1202 can determine if a specified duration for the armed stated has elapsed, as depicted at block 1322. If the specified duration for the armed stated has not elapsed, the master processor 502' and the slave processor 504' can continue reading the trigger channel input(s), as depicted in FIG. 13 by the process 1300 returning to block 1316. If the specified duration for the armed stated has elapsed, the data acquisition board can switch to the unarmed state, as depicted in FIG. 13 by the process 1300 returning to block 1306.

In additional or alternative aspects, the data acquisition board 1202 can operate in the slow sampling state. The slow sampling state can include the data acquisition board being configure to continuously storing by storing data obtained from some or all channel inputs to the memory 428' at a slow sampling rate. In some aspects, the slow sampling rate can be varied based on the state of the data acquisition board. For example, the slow sampling rate may be one sample every eights second for the unarmed state and one sample per second in the armed state.

The foregoing description, including illustrated aspects and examples, has been presented only for the purpose of illustration and description and is not intended to be exhaustive or limiting to the precise forms disclosed. Numerous modifications, adaptations, and uses thereof will be apparent to those skilled in the art without departing from the scope of this disclosure.

What is claimed is:

1. A sensing tool configured for being disposed in a wellbore through a fluid-producing formation, the sensing tool comprising:

at least one sensor;

a first processor and a second processor positioned in an isolated chamber of the sensing tool, wherein the first processor and the second processor are communicatively coupled to the at least one sensor; and a non-transitory computer readable medium in which instructions executable by the first processor and the second processor are stored, wherein the non-transitory computer readable medium is communicatively coupled to the first processor and the second processor, wherein the instructions comprise:

instructions for communicatively coupling an external control device to the sensing tool to configure the sensing tool prior to being disposed in the wellbore;

instructions for downloading data related to a previous downhole job from the external control device to the sensing tool to configure the sensing tool for a parameter including at least one of a channel number, a threshold strain value, a threshold acceleration value, a threshold pressure value, a threshold velocity value or an arming threshold value;

instructions for using the first processor for sampling data for storage in a memory device from the at least one sensor at a first sampling rate associated with deployment of a perforating string, wherein the data is associated with at least one of a tension state, a compression state, a bending state, or a torsion state experienced during the deployment of the perforating string;

instructions for detecting a trigger condition associated with a perforation operation performed by the perforating string;

instructions for switching to a second sampling rate for sampling data from the at least one sensor in response to detecting the trigger condition, wherein the second sampling rate is greater than the first sampling rate and is associated with the perforation operation of the perforating string; and instructions for using the first processor and the second processor for sampling data for storage in the memory device at the second sampling rate for a period of time in which the perforation operation is at least partially performed.

2. The sensing tool of claim 1, wherein the instructions further comprise instructions for switching to at least one of the first sampling rate and an intermediate sampling rate between the first sampling rate and the second sampling rate in response to the period of time elapsing.

3. The sensing tool of claim 1, wherein the at least one sensor comprises at least one accelerometer, wherein the perforation operation performed by the perforating string comprises a detonation of at least one perforating gun, wherein the trigger condition comprises an acceleration or velocity measured by the at least one accelerometer exceeding the threshold acceleration or velocity value associated with the detonation of the at least one perforating gun.

4. The sensing tool of claim 1, wherein the at least one sensor comprises at least one pressure sensor, wherein the trigger condition comprises a pressure in the wellbore measured by the at least one pressure sensor exceeding the threshold pressure value associated with the perforation operation.

5. The sensing tool of claim 1, wherein the at least one sensor comprises at least one strain sensor, wherein the trigger condition comprises a strain in the perforating string measured by the at least one strain sensor exceeding the threshold strain value associated with the perforation operation.

6. The sensing tool of claim 1, wherein the instructions for sampling data at the first sampling rate comprise instructions for selecting the first sampling rate for capturing data with respect to operations occurring over a period of time greater than or equal to one hour.

7. The sensing tool of claim 1, wherein the instructions for sampling data at the second sampling rate comprise instructions for selecting the second sampling rate for capturing data with respect to operations occurring over a period of time less than or equal to one minute.

8. The sensing tool of claim 1, wherein the perforation operation comprises a detonation of at least one perforating gun of the perforating string.

9. A perforating string configured for being disposed in a wellbore through a fluid-producing formation, the perforating string comprising:

at least one perforating gun; and a sensing tool connected to the at least one perforating gun, the sensing tool comprising:

at least one sensor;

a first processor and a second processor communicatively coupled to the at least one sensor, the second processor positioned in an isolated chamber of the sensing tool; and a non-transitory computer readable medium in which instructions executable by the first processor and the second processor are stored, wherein the non-transitory computer readable medium is communicatively coupled to the first processor and the second processor, wherein the instructions comprise:

instructions for communicatively coupling an external control device to the sensing tool to configure the sensing tool prior to being disposed in the wellbore;

instructions for downloading data related to a previous downhole job from the external control device to the sensing tool to configure the sensing tool for a parameter including at least one of a channel number, a threshold strain value, a threshold acceleration value, a threshold pressure value, a threshold velocity value or an arming threshold value;

instructions for sampling data using the first processor for storage in a memory device from the at least one sensor at a first sampling rate associated with deployment of the perforating string, wherein the data is associated with at least one of a tension state, a compression state, a bending state, or a torsion state experienced with respect to the deployment of the perforating string;

instructions for detecting a trigger condition associated with a perforation operation performed by the perforating string;

instructions for switching to a second sampling rate for sampling data from the at least one sensor in response to detecting the trigger condition, wherein the second sampling rate is greater than the first sampling rate and is associated with the perforation operation of the perforating string; and instructions for sampling data using the second processor for storage in the memory device at the second sampling rate for a period of time in which the perforation operation is at least partially performed.

10. The perforating string of claim 9, wherein the at least one sensor comprises at least one accelerometer, wherein the perforation operation performed by the perforating string comprises a detonation of the at least one perforating gun, wherein the trigger condition comprises an acceleration or velocity measured by the at least one accelerometer exceeding the threshold acceleration or velocity value associated with the detonation of the at least one perforating gun.

11. The perforating string of claim 9, wherein the at least one sensor comprises at least one pressure sensor, wherein the trigger condition comprises a pressure in the wellbore measured by the at least one pressure sensor exceeding the threshold pressure value associated with the perforation operation.

12. The perforating string of claim 9, wherein the at least one sensor comprises at least one strain sensor, wherein the trigger condition comprises a strain in the perforating string measured by the at least one strain sensor exceeding the threshold strain value associated with the perforation operation.

13. A method for capturing data regarding physical states of a perforating string disposed in a wellbore through a fluid-producing formation, the method comprising:

communicatively coupling an external control device to the sensing tool to configure the sensing tool prior to being disposed in the wellbore;

downloading data related to a previous downhole job from the external control device to the sensing tool to configure the sensing tool for a parameter including at least one of a channel number, a threshold strain value, a threshold acceleration value, a threshold pressure value, a threshold velocity value or an arming threshold value;

sampling data for storage in a memory device by a first processor at a first sampling rate from at least one sensor, wherein the at least one sensor measures at least one parameter indicative of at least one of a tension state, a compression state, a bending state, or a torsion state experienced during deployment of the perforating string, wherein the first sampling rate is associated with the deployment of the perforating string;

detecting a trigger condition associated with a perforation operation performed by the perforating string;

switching to a second sampling rate for sampling data from the at least one sensor in response to detecting the trigger condition, wherein the second sampling rate is greater than the first sampling rate and is associated with the perforation operation of the perforating string; and sampling data for storage in the memory device by the first processor and a second processor at the second sampling rate for a period of time in which the perforation operation is at least partially performed.

14. The method of claim 13, wherein the first sampling rate is selected for capturing data with respect to operations occurring over a period of time greater than or equal to one hour.

15. The method of claim 13, wherein the second sampling rate is selected for capturing data with respect to operations occurring over a period of time less than or equal to one minute.

16. The method of claim 13, wherein the at least one sensor comprises at least one accelerometer, wherein the perforation operation performed by the perforating string comprises a detonation of at least one perforating gun, wherein the trigger condition comprises an acceleration or velocity measured by the at least one accelerometer exceeding the threshold acceleration or velocity value associated with the detonation of the at least one perforating gun.

17. The method of claim 13, wherein the at least one sensor comprises at least one pressure sensor, wherein the trigger condition comprises a pressure in the wellbore measured by the at least one pressure sensor exceeding the threshold pressure value associated with the perforation operation.

18. The method of claim 13, wherein the at least one sensor comprises at least one strain sensor, wherein the trigger condition comprises a strain in the perforating string measured by the at least one strain sensor exceeding the threshold strain value associated with the perforation operation.

19. The method of claim 13, further comprising:

detecting a cessation of the trigger condition subsequent to detecting the trigger condition; and switching to the first sampling rate in response to detecting an absence of the trigger condition.

20. The method of claim 19 wherein the trigger condition comprises at least one of a temperature, a pressure, and a strain exceeding a threshold value and wherein detecting the cessation of the trigger condition comprises detecting that the at least one of the temperature, the pressure, and the strain is below the threshold value.

* * * * *